US009462396B2

(12) United States Patent
Flood et al.

(10) Patent No.: US 9,462,396 B2
(45) Date of Patent: Oct. 4, 2016

(54) HEARING ASSISTANCE COPLANAR WAVEGUIDE

(71) Applicant: Starkey Laboratories, Inc., Eden Prairie, MN (US)

(72) Inventors: Stephen Paul Flood, Eden Prairie, MN (US); Jay Rabel, Shorewood, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 185 days.

(21) Appl. No.: 14/049,965

(22) Filed: Oct. 9, 2013

(65) Prior Publication Data

US 2015/0098599 A1 Apr. 9, 2015

(51) Int. Cl.
*H04R 25/00* (2006.01)
*H01P 3/00* (2006.01)

(52) U.S. Cl.
CPC ..... *H04R 25/48* (2013.01); *H01P 3/003* (2013.01); *H04R 25/55* (2013.01); *H04R 25/554* (2013.01); *H04R 2225/51* (2013.01); *H04R 2225/59* (2013.01)

(58) Field of Classification Search
CPC ..... H04R 1/1016
USPC ..... 381/74, 312.313
See application file for complete search history.

(56) References Cited

U.S. PATENT DOCUMENTS 4,800,461 A 1/1989 Dixon et al.
5,072,074 A 12/1991 DeMaso et al.
7,202,755 B2 4/2007 Tabatabai
2010/0157858 A1 6/2010 Lee et al.
2010/0158291 A1 6/2010 Polinske et al.
2011/0121924 A1* 5/2011 White et al. ..... 333/260
2012/0094480 A1* 4/2012 Cho ..... 438/612
2013/0343564 A1* 12/2013 Darlington ..... 381/74

FOREIGN PATENT DOCUMENTS

EP 2860991 A1 4/2015

OTHER PUBLICATIONS

"European Application Serial No. 14188262.1, Extended European Search Report mailed Feb. 10, 2015", 8 pgs.

(Continued)

*Primary Examiner* — Duc Nguyen
*Assistant Examiner* — Phan Le
(74) *Attorney, Agent, or Firm* — Schwegman Lundberg & Woessner, P.A.

(57) ABSTRACT

Disclosed herein, among other things, are methods and apparatuses that provide a manufacturable RF transmission line to go through the bend area of a flexible circuit to be used in a compact design, such as in a compact hearing aid design. One aspect of the present subject matter relates to using multiple inner layers of the flexible circuit to route RF transmission. By not using outer layers, the RF transmission line will be less susceptible to delamination from the polyimide dielectric layer. One aspect of the present subject matter relates to choosing copper transmission line to have dimensions that allow for narrower transmission lines with good RF return loss. The copper transmission line dimensions also allow for manufacturing in a standard process without adding extra cost.

22 Claims, 4 Drawing Sheets

(56) References Cited

OTHER PUBLICATIONS

Bedair, S S, et al., "Fast and accurate analytic formulas for calculating the parameters of a general broadside-coupled coplanar waveguide for (M)MIC application", IEEE Transactions on Microwave Theory and Techniques, Ieee Service Center, Piscataway, NJ, US, vol. 37, No. 5, (May 1, 1989), 843-850.

Leo, Maloratsky, "Passive RF and Microwave Integrated Circuits", ELSEVIER, NEWNES, (Dec. 1, 2003).

Ngueyn, C, "Broadside-Coupled Coplanar Waveguides and Their End-Coupled Band-Pass Filter Applications", IEEE Transactions on Microwave Theory and Techniques, Ieee Service Center, Piscataway, NJ, US, vol. 40, No. 12, (Dec. 1, 1992), 2181-2189.

* cited by examiner

HEARING ASSISTANCE COPLANAR WAVEGUIDE

FIELD OF THE INVENTION

The present subject matter relates generally to hearing assistance devices, and in particular to waveguides for hearing assistance devices.

BACKGROUND

Modern hearing assistance devices, such as hearing aids, are electronic instruments worn in or around the ear that compensate for hearing losses by specially amplifying sound. Hearing aids typically include electronic components mounted on or attached to printed circuit boards to enhance the wearer's listening experience.

To accommodate the relatively small hearing aid form factor, hearing aid radio frequency (RF) transmission lines may be implemented on flexible circuit boards. However, the performance of RF transmission lines is limited when using flexible circuit boards, especially in areas of the flexible circuit boards that are bent to accommodate the hearing aid form factor.

In order to provide a manufacturable RF transmission line for a flexible circuit bend area that provides improved RF performance, existing solutions use microstrip or stripline configurations. These microstrip or stripline configurations may use external layers. However, these microstrip or stripline exhibit excessively narrow transmission lines. Such excessively narrow transmission lines are difficult to manufacture, as the manufacturing tolerance variations tend to exceed the requirements of the narrow transmission lines. Additionally, microstrip or stripline antennas using the external layers of the flexible circuit would have problems with delamination of the copper from the flexible circuit polyimide layer.

Some existing coplanar waveguides include methods of constructing coplanar waveguides on semi-rigid boards. These are a combination regular circuit board and flexible circuit board. Other existing coplanar waveguides include an air gap within the coplanar waveguide.

What is needed in the art is an improved system that provides a manufacturable RF transmission line for a flexible circuit bend area that provides improved RF performance.

SUMMARY

Disclosed herein, among other things, are methods and apparatuses that provide a manufacturable RF transmission line to go through the bend area of a flexible circuit to be used in a compact design, such as in a compact hearing aid design.

One aspect of the present subject matter relates to using multiple inner layers of the flexible circuit to route RF transmission. By not using outer layers, the RF transmission line will be less susceptible to delamination from the polyimide dielectric layer. One aspect of the present subject matter relates to selecting copper transmission line dimensions that can withstand manufacturing tolerance variations. The copper transmission line dimensions also allow for manufacturing in a standard process without adding extra cost. Other aspects are provided without departing from the scope of the present subject matter.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Disclosed herein, among other things, are methods and apparatuses for transmitting radio waves from an RF source to an antenna, such as in a compact hearing aid design.

Figure 1:
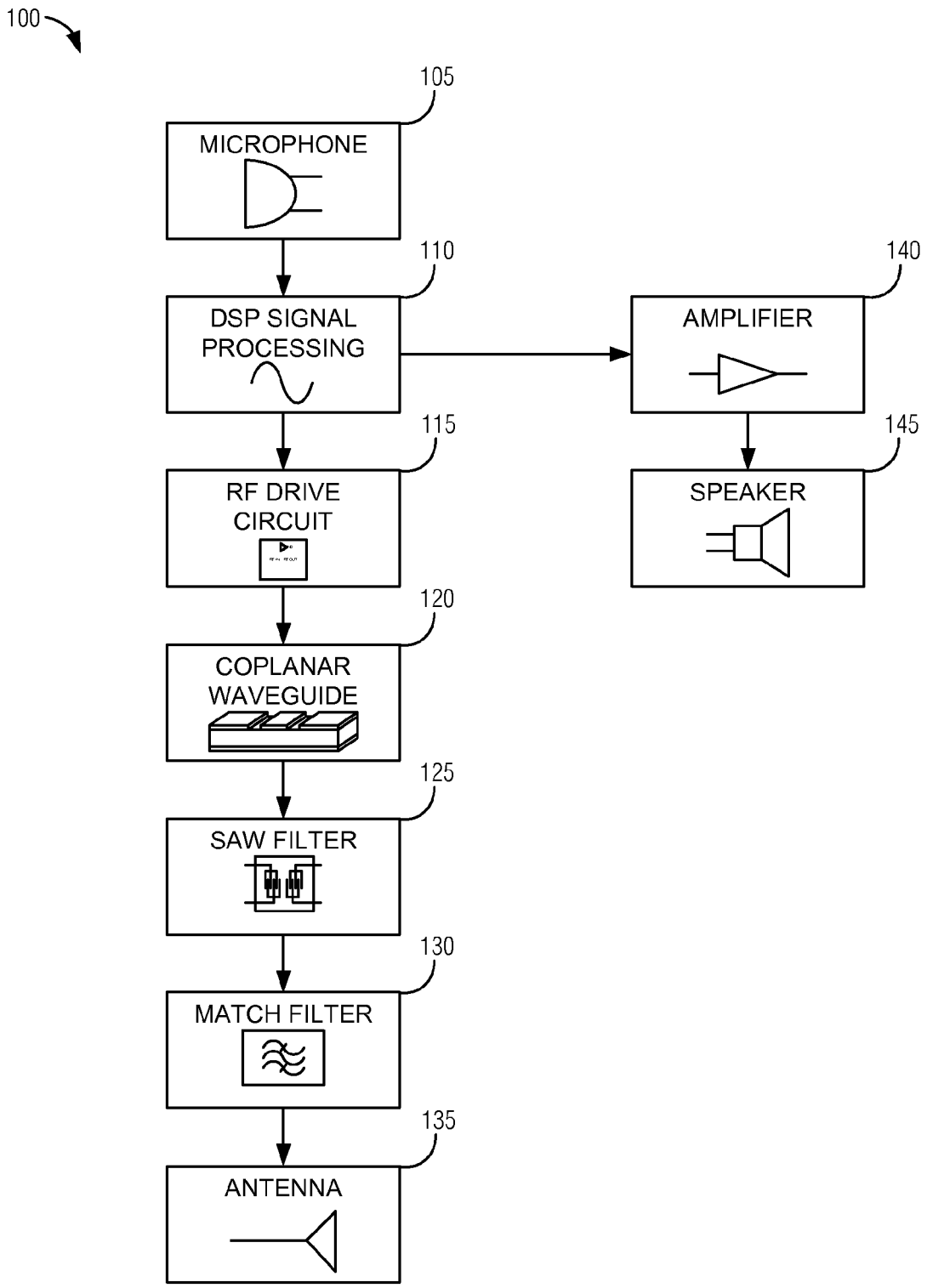
FIG. 1 shows a circuit diagram of a hybrid circuit configured for use in a hearing aid, according to one embodiment of the present subject matter.

FIG. 1 shows a circuit diagram of an embodiment of a hybrid circuit 100 configured for use in a hearing aid. Hybrid circuit 100 includes a microphone 105, a signal-processing unit 110, an RF drive circuit 115, a coplanar waveguide 120, a standing acoustic wave (SAW) filter 125, a match filter 130, and an antenna 135. Physically, hybrid circuit 100 can be realized as a single compact unit having an integrated coplanar waveguide 120.

Signal processing unit 110 provides the electronic circuitry for processing received signals from the microphone 105 for wireless communication between a hearing aid in which hybrid circuit 100 is configured and a source external to the hearing aid. The source external to the hearing aid can be used to provide information transferal for testing and programming of the hearing aid.

Signal processing unit 110 may provide processed signals to the RF drive circuit 115, which may have leads to couple to coplanar waveguide 120. Because the coplanar waveguide 120 provides a low-profile transmission line that may be mounted directly on a circuit board, the coplanar waveguide 120 may be used in compact designs. Additionally, the coplanar waveguide 120 may provide high frequency response, as the design of the coplanar waveguide 120 avoids parasitic discontinuities in the ground plane.

Coplanar waveguide 120 may be coupled to a SAW filter 125 to use an analog filter to match the complex impedance of the coplanar waveguide to the impedance of the antenna 135. Complex impedance may be matched further by coupling the coplanar waveguide 120 and SAW filter 125 to a match filter 130. Impedance matching may also be performed within the coplanar waveguide 120 by distributing impedance matching elements within the coplanar waveguide 120. For example, the coplanar waveguide 120 may include a matching network (e.g., inductors, capacitors, etc.) to perform impedance matching. In some embodiments, the coplanar waveguide 120 may include a series of waveguides connected through various RLC networks.

Signal processing unit 110 may also provide the processing of signals representing sounds, whether received as acoustic signals or electromagnetic signals. Hybrid circuit 100 may also include an amplifier 140 and a speaker 145.

Signal processing unit 110 provides an output that is increased by amplifier 140 to a level that allows sounds to be audible to the hearing aid user. Amplifier 140 may be realized as an integral part of signal processing unit 110. As can be appreciated by those skilled in the art upon reading and studying this disclosure, the elements of a hearing aid housed in a hybrid circuit that includes an integrated coplanar waveguide can be configured in various formats relative to each other for operation of the hearing aid.

The elements of hybrid circuit 100 are implemented in the layers of hybrid circuit 100 providing a compact circuit for a hearing aid. In an embodiment, a hearing aid using a hybrid circuit shown as hybrid circuit 100 is a CIC hearing aid operating at a frequency suitable for wireless communication exterior to the hearing aid. In an embodiment, the coplanar waveguide for the CIC hearing aid is configured in a hybrid circuit as a substrate based coplanar waveguide. In another embodiment, the coplanar waveguide for the CIC hearing aid is configured in a hybrid circuit as a flex coplanar waveguide. The resulting circuit may be designed for a number of different frequencies, or may be designed to be relatively frequency independent. For example, in one embodiment, the circuit is adapted to operate at about 916 MHz. As another example embodiment, the circuit is adapted to operate at about 900 MHz. Other frequencies of operation are possible, and the ones stated herein are intended to demonstrate the flexibility of the circuit design. In various embodiments, the circuit is designed to be relatively frequency independent, to operate over a range of frequencies. Therefore, various embodiments of hybrid circuit 100 may operate at different frequencies covering a wide range of operating frequencies without departing from the present subject matter.

Figure 2:
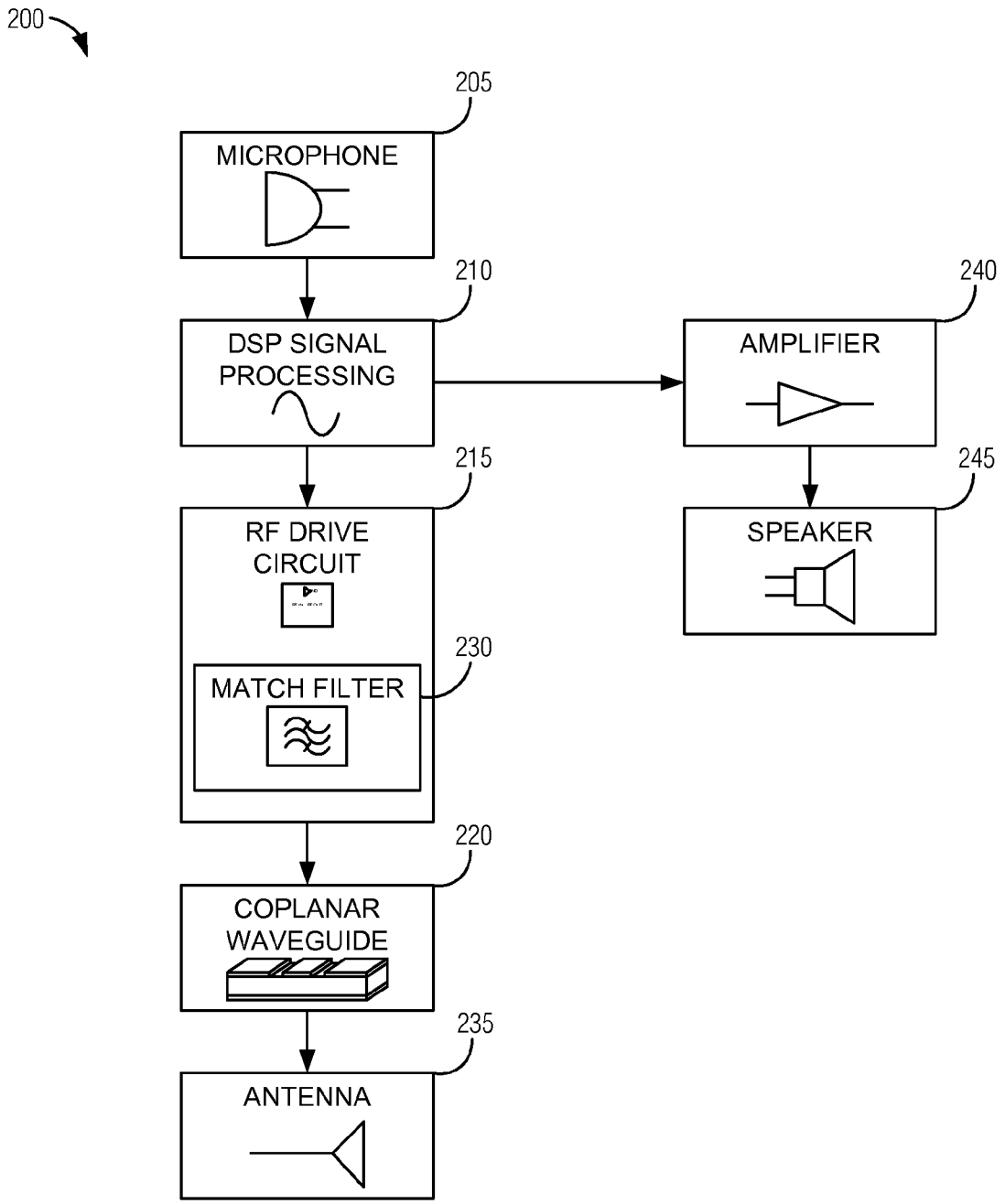
FIG. 2 shows a circuit diagram of a hybrid circuit with integrated match filter configured for use in a hearing aid, according to one embodiment of the present subject matter.

FIG. 2 shows a circuit diagram of an embodiment of a hybrid circuit 200 with integrated match filter configured for use in a hearing aid. Hybrid circuit 200 includes a microphone 205, a signal-processing unit 210, an RF drive circuit 215, a match filter 230, a coplanar waveguide 220, and an antenna 235. The RF drive circuit 215 may be manufactured to include the match filter 230 to enable a compact design. Hybrid circuit 200 may also include an amplifier 240 and a speaker 245 to provide for processing of signals representing sounds.

Figure 3:
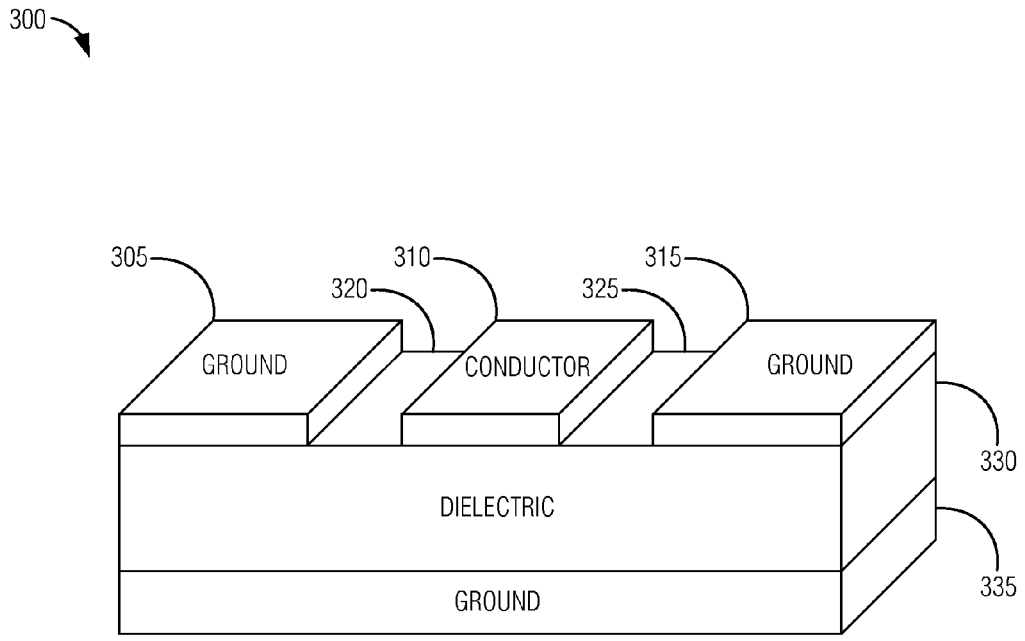
FIG. 3 shows a perspective diagram of a coplanar waveguide according to one embodiment of the present subject matter.

FIG. 3 shows a perspective diagram of a coplanar waveguide 300. One layer of the coplanar waveguide 300 may include a first ground conductor 305 (e.g., ground trace), a conductor 310, and a second ground conductor 315. The first ground conductor 305 and the conductor 310 may be separated by a first gap 320, and the conductor 310 and the second ground conductor 315 may be separated by a second gap 325. The conductor 310 and the first and second ground conductors 305 and 315 may be affixed to a dielectric 330. The coplanar waveguide 300 may include an optional third ground conductor 335, where the optional third ground conductor 335 may be affixed to the side of the dielectric 330 opposite from the conductor 310 and the first and second ground conductors 305 and 315. In some embodiments, a second dielectric may be arranged on the first and second ground conductors 305 and 315 and on the conductor 310. The second dielectric may fill the first and second gaps 320 and 325.

If the coplanar waveguide is limited to a single layer, manufacturing tolerances may vary excessively, degrading return loss below the desired performance level. With the coplanar waveguide implemented on the two layers, however, the return loss performance may increase from approximately 10 dB to greater than 30 dB, such as is shown in FIG. 4.

Figure 4:
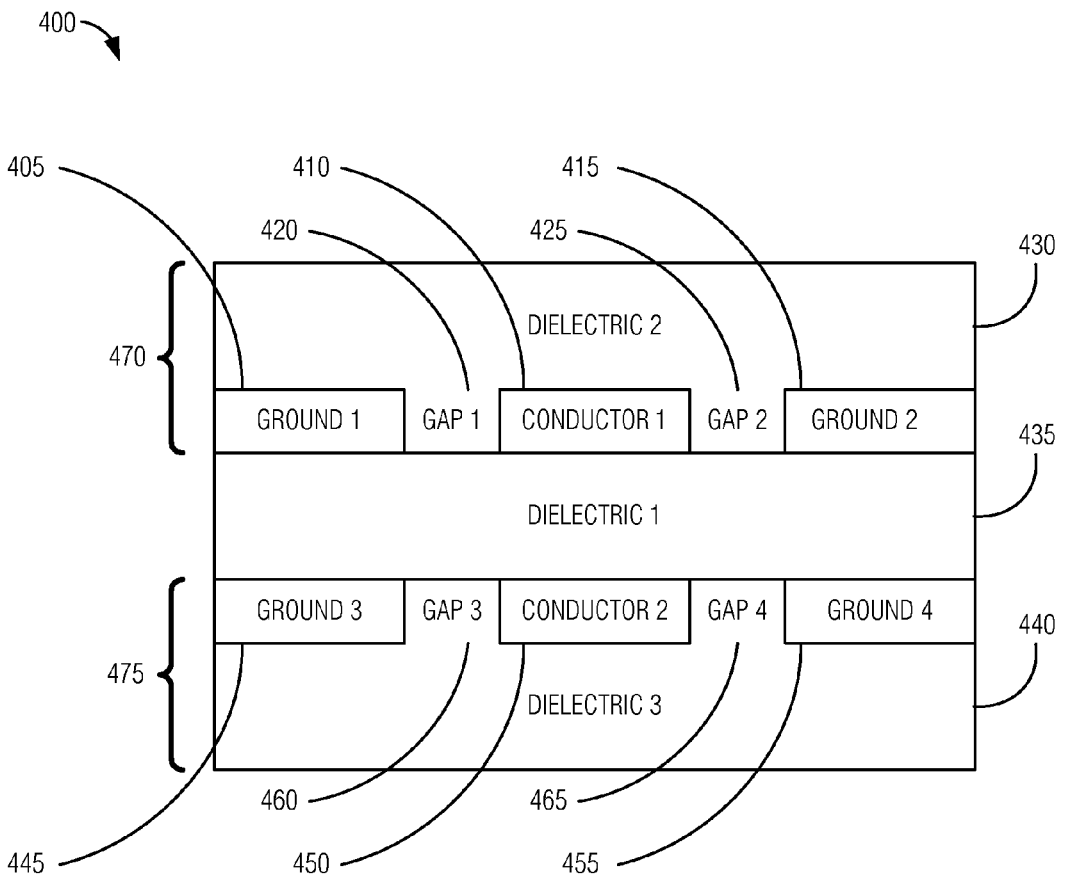
FIG. 4 shows a diagram of a multiple layer coplanar waveguide according to one embodiment of the present subject matter.

FIG. 4 shows a diagram of a multiple layer coplanar waveguide 400. One layer of the multiple layer coplanar waveguide 400 may include a first ground conductor 405, a first conductor 410, and a second ground conductor 415. The first ground conductor 405 and the first conductor 410 may be separated by a first gap 420, and the first conductor 410 and the second ground conductor 415 may be separated by a second gap 425. The first conductor 410 and the first and second ground conductors 405 and 415 may be affixed to a second dielectric 430, and the second dielectric 430 may fill the first and second gaps 420 and 425. The first conductor 410, first and second ground conductors 405 and 415, and second dielectric 430 may be affixed to a first dielectric 435. The first dielectric 435 may be affixed to a third ground conductor 445, a second conductor 450, and a fourth ground conductor 455. The third ground conductor 445 and the second conductor 450 may be separated by a third gap 460, and the second conductor 450 and the fourth ground conductor 455 may be separated by a fourth gap 465. The second conductor 450 and the third and fourth ground conductors 445 and 455 may be affixed to a third dielectric 440, and the third dielectric 440 may fill the third and fourth gaps 460 and 465. The arrangement of second dielectric 430, first and second ground conductors 405 and 415, first conductor 410, and first and second gaps 420 and 425 may form a first coplanar waveguide layer 470. Similarly, the arrangement of third dielectric 440, third and fourth ground conductors 445 and 455, second conductor 450, and third and fourth gaps 460 and 465 may form a second coplanar waveguide layer 475. In various embodiments, additional layers of coplanar waveguide layers may be formed on the first or second coplanar waveguide layers 470 and 475.

The ground conductors 405, 415, 445, and 455 may be mutually electrically coupled. For example, first and second ground conductors 405 and 415 may be physically connected, such as forming a U-shape. The first and second ground conductors 405 and 415 may be electrically coupled to the third and fourth ground conductors 445 and 455 using an electrically conductive via (e.g., a buried via) through the first dielectric 435. The ground conductors 405, 415, 445, and 455 may be electrically coupled using wires or other means.

The first conductor 410 and second conductor 450 may be mutually electrically coupled. For example, first and second conductors 410 and 450 may be physically connected at the beginning and end of the line. The first and second conductors 410 and 450 may be electrically coupled using an electrically conductive via (e.g., a buried via) through the first dielectric 435.

The geometry of the various elements within the multiple layer coplanar waveguide 400 (e.g., conductor line width, conductor height, gap width, dielectric height) and dielectric material selection may determine the characteristic impedance of the first and second conductors 410 and 450. The geometry of gaps 420, 425, 460, and 465 may be arranged according to the wavelength of the intended transmission frequency, where the ratio of the line width to the gaps is adjusted to provide optimum return loss. In some embodiments, the gaps 420, 425, 460, and 465 may be arranged to provide proper spacing in the first and second conductors 410 and 450. For example, the first and second conductors 410 and 450 may be approximately twice as wide as the gaps 420, 425, 460, and 465. In some embodiments, the gaps 420, 425, 460, and 465 may be arranged to avoid signal degradation due to higher harmonics. For example, the gaps 420, 425, 460, and 465 may be arranged at a spacing of 40 millimeters, which may reduce adverse effects from fourth or fifth harmonics. The gaps 420, 425, 460, and 465 may be generated by etching. The gaps 420, 425, 460, and 465 may include a polyimide layer, where the polyimide may function as an adhesive. Because of the reduced sensitivity of the line width and gap width to manufacturing tolerances, the multiple layer coplanar waveguide 400 is able to yield better return loss over manufacturing tolerances.

The layers used in FIG. 4 may be implemented in a compact, flexible circuit design. However, flexible circuit designs are subject to delamination of outer layers. Existing RF transmission lines may use micro-strip or stripline within these internal layers. Within the inner layers of the flexible circuit, the dielectric thickness may be reduced to 0.001 inch or less. The thin dielectric layers within microstrip, stripline, and single-layer CPW, yield narrow line widths. These narrow line widths would be susceptible to standard manufacturing tolerances for polyimide flexible circuit technology, resulting in inconsistent (unit-to-unit) or significantly degraded performance of the transmission line.

The layers used in FIG. 4 may be implemented within a flexible circuit board. By implementing the coplanar waveguide on inner layers within a flexible circuit board, the multi-layer design may improve performance of the RF transmission line, while meeting the design constraints of the flexible circuit design. The flexible circuit design may be used to allow folding of the circuit board to fit compactly in a hearing aid design. In various embodiments, the coplanar waveguide may be used within ceramic substrate designs and on rigid printed circuit board designs. Additional layers can be used in various embodiments.

In some embodiments, the dielectric layers 430, 435, and 440 may be selected to include materials that are lightweight, flexible, and resistant to heat and chemicals. For example, the dielectric layers dielectric layers 430, 435, and 440 may be selected to include one or more polyimides. In some embodiments, the first and third dielectric layers 430 and 440 include a first dielectric material, and the first dielectric layer 435 includes a different dielectric material than the second and third dielectric layers 430 and 440.

It is understood that variations in communications circuits, protocols, antenna configurations, and combinations of components may be employed without departing from the scope of the present subject matter. Hearing assistance devices typically include an enclosure (e.g., housing), a microphone, a speaker, a receiver, and hearing assistance device electronics including processing electronics. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that a variety of hearing assistance devices may be used without departing from the scope and the devices described herein are intended to demonstrate the subject matter, but not in a limited, exhaustive, or exclusive sense. It is also understood that the present subject matter can be used with devices designed for use in the right ear or the left ear or both ears of the wearer.

It is understood that hearing aids typically include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples may omit certain modules that perform frequency synthesis, frequency analysis, analog-to-digital conversion, digital-to-analog conversion, amplification, and certain types of filtering and processing. In various embodiments, the processor is adapted to perform instructions stored in memory that may or may not be explicitly shown. Various types of memory may be used, including volatile and nonvolatile forms of memory. In various embodiments, instructions are performed by the processor to perform a number of signal processing tasks. In such embodiments, analog components may be in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), receiver-in-canal (RIC), and completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used with in-the-ear (ITE) and in-the-canal (ITC) devices. The present subject matter can also be used with wired or wireless ear bud devices. The present subject matter can also be used in hearing assistance devices generally, such as cochlear implant type hearing devices and such as deep insertion devices having a transducer, such as a receiver or microphone, whether custom fitted, standard, open fitted, or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

The preceding detailed description of the present subject matter refers to subject matter in the accompanying drawings that show, by way of illustration, specific aspects and embodiments in which the present subject matter may be practiced. These embodiments are described in sufficient detail to enable those skilled in the art to practice the present subject matter. References to "an," "one," or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

What is claimed is:

1. A hearing assistance coplanar radio frequency (RF) waveguide comprising:

a first ground conductor disposed on a first side of a first dielectric;

a first RF waveguide conductor disposed on the first side of the first dielectric, wherein the first ground conductor and the first RF waveguide conductor are separated by a first gap;

a second ground conductor disposed on the first side of the first dielectric, wherein the second ground conductor and the first RF waveguide conductor are separated by a second gap;

a third ground conductor disposed on a second side of the first dielectric;

a second RF waveguide conductor disposed opposite from the first RF waveguide conductor on the second side of the first dielectric, wherein the third ground conductor and the second RF waveguide conductor are separated by a third gap;

a fourth ground conductor disposed on the second side of the first dielectric, wherein the fourth ground conductor and the second RF waveguide conductor are separated by a fourth gap; and a second dielectric disposed on the first ground conductor, first RF waveguide conductor, and second ground conductor, wherein the second dielectric extends into the first and second gap, and at least a portion of the second dielectric contacts at least a portion of the first side of the first dielectric.

2. The hearing assistance coplanar RF waveguide of claim 1, further comprising a third dielectric, wherein:

the third dielectric is disposed on the third ground conductor, second RF waveguide conductor, and fourth ground conductor;

the third dielectric extends into the third and fourth gap; and at least a portion of the third dielectric contacts at least a portion of the second side of the first dielectric.

3. The hearing assistance coplanar RF waveguide of claim 2, wherein:

the first dielectric includes a first dielectric material; and the second and third dielectrics include a second dielectric material, wherein the first dielectric material is different from the second dielectric material.

4. The hearing assistance coplanar RF waveguide of claim 2, wherein the first, second, and third dielectric layers include a polyimide.

5. The hearing assistance coplanar RF waveguide of claim 4, wherein the polyimide includes an adhesive.

6. The hearing assistance coplanar RF waveguide of claim 2, wherein the at least one of the first, second, third, or fourth gaps is arranged according to the wavelength of the intended transmission frequency.

7. The hearing assistance coplanar RF waveguide of claim 2, wherein the dimensions of at least one dielectric is arranged to reduce signal degradation due to higher harmonics.

8. The hearing assistance coplanar RF waveguide of claim 2, wherein the first, second, third, and fourth ground conductors are electrically coupled.

9. The hearing assistance coplanar RF waveguide of claim 2, wherein conductor 1 and conductor 2 are electrically coupled.

10. A hearing assistance device comprising:

a radio frequency driver component;

a coplanar radio frequency (RF) waveguide coupled to the radio frequency driver component, the coplanar RF waveguide including:

a first ground conductor disposed on a first side of a first dielectric;

a first RF waveguide conductor disposed on the first side of the first dielectric, wherein the first ground conductor and the first RF waveguide conductor are separated by a first gap;

a second ground conductor disposed on the first side of the first dielectric, wherein the second ground conductor and the first RF waveguide conductor are separated by a second gap;

a third ground conductor disposed on a second side of the first dielectric;

a second RF waveguide conductor disposed opposite from the first RF waveguide conductor on the second side of the first dielectric, wherein the third ground conductor and the second RF waveguide conductor are separated by a third gap;

a fourth ground conductor disposed on the second side of the first dielectric, wherein the fourth ground conductor and the second RF waveguide conductor are separated by a fourth gap; and a second dielectric disposed on the first ground conductor, first RF waveguide conductor, and second ground conductor, wherein the second dielectric extends into the first and second gap, and at least a portion of the second dielectric contacts at least a portion of the first side of the first dielectric; and an antenna coupled to the coplanar RF waveguide.

11. The hearing assistance device of claim 10, further comprising an impedance matching filter coupled to the radio frequency driver component and to the coplanar RF waveguide.

12. The hearing assistance device of claim 10, wherein the radio frequency driver component includes an impedance matching filter.

13. The hearing assistance device of claim 10, further comprising an impedance matching filter coupled to the coplanar RF waveguide and to the antenna.

14. The hearing assistance device of claim 10, further comprising a standing acoustic wave filter coupled to the coplanar RF waveguide and to the antenna.

15. The hearing assistance device of claim 10, further comprising a signal processing component coupled to the radio frequency driver component.

16. The hearing assistance device of claim 15, further comprising a microphone coupled to the signal processing component.

17. The hearing assistance device of claim 15, further comprising an amplifier coupled to the signal processing component.

18. The hearing assistance device of claim 15, further comprising a speaker coupled to the amplifier.

19. A hearing assistance system, the system comprising:

a radio frequency (RF) driver component;

an antenna; and a waveguide means for propagating a radio frequency signal from the radio frequency driver component to the antenna, the waveguide means include an RF waveguide, the RF waveguide including:

a first ground conductor disposed on a first side of a first dielectric;

a first RF waveguide conductor disposed on the first side of the first dielectric, wherein the first ground conductor and the first RF waveguide conductor are separated by a first gap;

a second ground conductor disposed on the first side of the first dielectric, wherein the second ground conductor and the first RF waveguide conductor are separated by a second gap;

a third ground conductor disposed on a second side of the first dielectric;

a second RF waveguide conductor disposed opposite from the first RF waveguide conductor on the second side of the first dielectric, wherein the third ground conductor and the second RF waveguide conductor are separated by a third gap;

a fourth ground conductor disposed on the second side of the first dielectric, wherein the fourth ground conductor and the second RF waveguide conductor are separated by a fourth gap; and a second dielectric disposed on the first ground conductor, first RF waveguide conductor, and second ground conductor, wherein the second dielectric extends into the first and second gap and at least a portion of the second dielectric contacts at least a portion of the first side of the first dielectric.

20. The hearing assistance system of claim 19, further comprising an impedance matching filter coupled to the radio frequency driver component and to the waveguide means.

21. The hearing assistance device of claim 19, further comprising a standing acoustic wave filter coupled to the waveguide means and to the antenna.

22. The hearing assistance device of claim 19, further comprising a signal processing component coupled to the radio frequency driver component.

* * * * *